US006412205B1

(12) United States Patent
Cheresko

(10) Patent No.: US 6,412,205 B1
(45) Date of Patent: Jul. 2, 2002

(54) INFORMATION LABELING SYSTEM

(76) Inventor: Daniel Cheresko, 11300 N. Fairlane Dr., S. Lyon, MI (US) 48178

( * ) Notice: Subject to any disclaimer, the term of this patent is extended or adjusted under 35 U.S.C. 154(b) by 0 days.

(21) Appl. No.: 09/512,545

(22) Filed: Feb. 24, 2000

(51) Int. Cl.[7] ..... G09F 7/06
(52) U.S. Cl. ..... 40/665; 40/622; 40/668
(58) Field of Search ..... 40/622, 655, 668, 40/547, 654, 675

(56) References Cited

U.S. PATENT DOCUMENTS 4,107,861 A * 8/1978 Johnson ..... 40/654
5,644,860 A * 7/1997 Piper et al. ..... 40/579
5,783,281 A * 7/1998 Man ..... 428/138

* cited by examiner

*Primary Examiner*—William A. Cuchlinski, Jr.
*Assistant Examiner*—Marthe Y. Marc-Coleman
(74) *Attorney, Agent, or Firm*—Gifford, Krass, Groh, Sprinkle, Anderson & Citkowski, P.C.

(57) ABSTRACT

An information labeling system including a substrate having a plurality of holes arranged in an array of predetermined positions. A perforatable information label having datum points in an array of known positions adapted to be aligned in registry with the arrayed plurality of holes on the substrate. A pair of guide posts extending from the substrate surface and assisting in the aligning of the datum points relative to the receiving holes and such that perforation of the label at appropriate datum points reflects information described by the datum points. An adjustable and elongate member extends from the substrate and fits it about a device.

22 Claims, 2 Drawing Sheets

INFORMATION LABELING SYSTEM

BACKGROUND OF THE INVENTION

1. Field of the Invention

The present invention relates to information systems. More particularly, the present invention concerns information labels having datum points including a substrate having a plurality of holes arrayed in known positions, upon which may be mounted the information label, in a manner such that the datum points are in registry with the arrayed plurality of holes, such that the user can then perforate the label at the appropriate datum points reflecting the condition described by that datum point.

2. Description of Related Art

Information labels have existed for many years. Typically, the label may have a single piece of information printed on the label, or may have a list of possible conditions in a single information category arranged in a list, with the appropriate box for the applicable condition to be checked by the user, typically with some writing instrument. Such labels are often provided with a self-adhesive on the back such that the label can be mounted directly to the device to which the information pertains.

The existing art also includes much more technologically sophisticated information labeling systems such as bar codes. Of course, bar code systems require additional components, such as a computer data base into which is programmed the particular information to be reflected about a specific device, with a label making-system attached to create the appropriate bar code label. The user must subsequently use a bar code scanner to then decode the information for understanding by the user.

The present invention provides an advancement over such information systems by providing an inexpensive and yet reusable substrate onto which can be placed a sequential series of information labels to reflect any changed condition which the label is to convey to the user of the end device. The information label system also contains a simple securement means by which the system can be attached to the device about which information is to be conveyed.

SUMMARY OF THE INVENTION

The present invention is an information label or labeling system providing a base to be attached to any of a variety of devices about which information is to be conveyed, with one of a broad selection on information labels from which is to be selected the label appropriate for the information and particular device to which it is applied. The information label may carry a single category of information or a variety of sub-categories of information, each of which is pertinent to a specific condition of the device being labeled. The information label system, according to the present invention, comprises:

(a) a substrate having a plurality of holes arranged in an array of known positions;

(b) means for securing the substrate to an outside device; and (c) a perforatable information label having dictum points in an array of known positions adapted to be aligned in registry with the arrayed plurality of holes on the substrate, whereby the perforation of specific datum points through the information label and into aligned ones of the plurality of arrayed holes indicates the positive condition applicable to the outside device as described by that perforated datum point.

In operation, the substrate upon which a label will be subsequently placed, is attached to an appropriate place on the outside device through use of the securing means.

The user selects the label appropriate to the information to be conveyed about the specific device to which the substrate has been attached.

By way of example, the label may be selected to convey the date of an oil change last made to an outside device such as a commercial lawnmower, which is used by any number of employees of the company owning the machine or the ratio of fluids such as oil and gasoline contained in an engine. The information label may bear a first sub-category of information, such as indicating which month of the year, a second sub-category of information, such as indicating which day of the month, and a final sub-category, such as indicating the weight of the oil used when last changed into the machine. The system hereof may also include an alignment structure or label guide such as a peripheral rim or bead integral with the substrate.

The user places the appropriate label upon the substrate, with the label guide on the substrate ensuring that the label is aligned properly on the substrate so that the datum points are in registry with the arrayed plurality of holes. The operator then perforates the appropriate datum points consistent with the oil that was being placed into the machine, so that the subsequent user would know that, for example, the previous oil change was made on June 1, using 10-W30 oil or that the engine is a 4:1 gasoline to oil engine.

For a more complete understanding of the present invention, the reader is referred to the following detailed description, which should be read in conjunction with the accompanying drawings. Throughout the following description and in the drawings, like reference numerals refer to like parts.

DETAILED DESCRIPTION OF A PREFERRED EMBODIMENT

Figure 1:
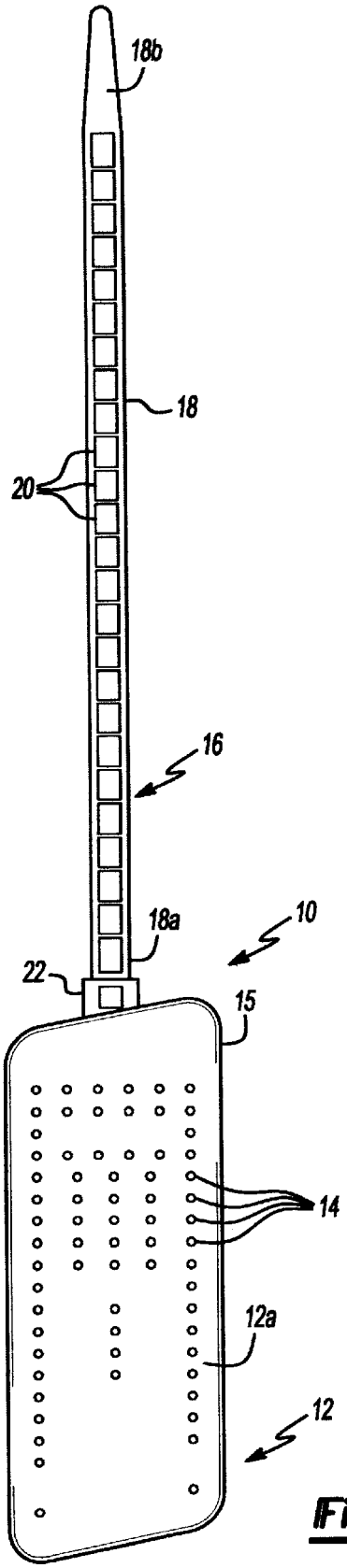
FIG. 1 is a top plan view of the information label system of the subject invention.
Figure 2:
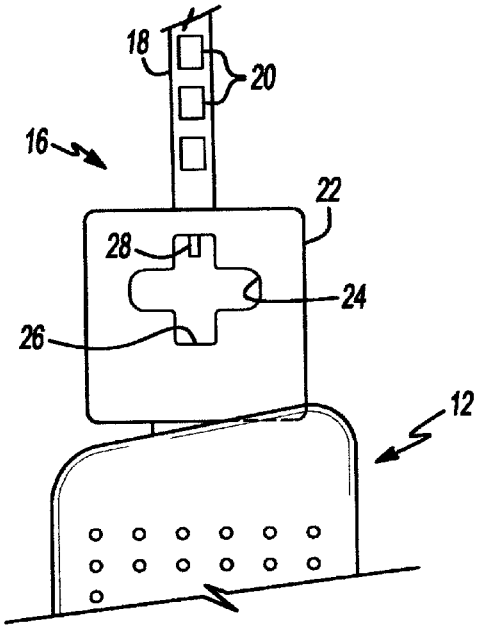
FIG. 2 is a fragmental view of the means for securing used in the subject invention.
Figure 3:
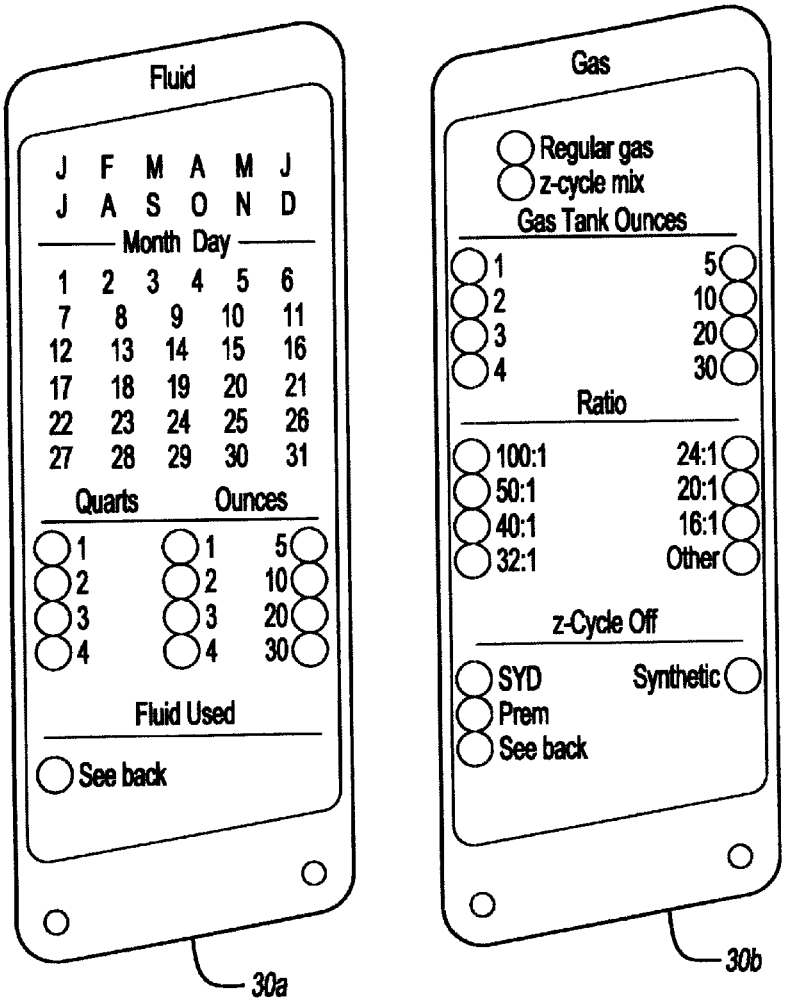
FIG. 3 is a front view of exemplary information labels usable in the information label system of the subject invention.

Referring now to FIGS. 1–3, there is shown an information label system of the present invention, generally denoted at 10. The information label system 10 of the present invention includes a substrate 12 which has a plurality of holes 14 arranged in an array of known positions. The substrate 12 is further provided with a guide member 15, which in the present embodiment comprises a raised rim around the periphery of the substrate which facilitates the proper alignment and registration of labels, as described below.

The information label system 10 includes a securement means 16 for securing the substrate 12 to an outside or external or other device. The securement means 16 is attached to the substrate 12 and is, preferably, integrally formed therewith, or otherwise secured thereto.

The substrate 12 is preferably formed of a plastic such as a high-density polyethylene plastic (HDPE) or the like and the securement means 16 is formed unitarily with the substrate 12 and is of the same material.

The securement means 16 may preferably comprise an elongate member 18 having a proximal end 18*a* and a tapered distal end 18*b* and containing a plurality of locking holes 20 formed along the extent thereof. At the proximal end 18*a* of the elongate member 18 nearest to the substrate 12, the securement means 16 may also include a securement gate 22 which has a tunnel or passageway 24 therein. The securement gate 22 may also have a rising ramp 26 and a locking tongue 28 which projects downwardly into the tunnel 24. According to this embodiment, a user wraps the elongate member 18 around a handle or other appropriate element of the external device and then inserts the tapered distal end 18*b* of the elongate member 18 into the securement gate 22 and pulls the distal end 18*b* until the elongate member has been drawn into the desired position. The locking tongue 28, which may be canted backward toward the loading side of the securement gate 22, thus engages the desired locking hole 20 along the elongate member 18 to secure the substrate 12 to the outside device to a degree of tightness chosen by the user. The canted angle of the locking tongue 28 ensures that the elongate member cannot be removed from the securement gate by pulling the elongate member back out of that gate.

The ramp 26 is formed within the tunnel 24 to rise as the elongate member 18 advances more deeply into the securement gate 22 to ensure that the locking tongue 28 is snugly engaged in a locking hole 20, thus preventing inadvertent loosening of the securement means 16 and loss of the substrate 12 from the outside device to which it is attached. The securement gate 22 has a front entry side which may be provided with a tapered access leading into the tunnel 24, which in combination with the tapered end 18*b* of the elongate member 18 serves both to identify the appropriate side of the securement gate into which the user is to insert the elongate member 18, as well as conveniencing the appropriate placement of those two pieces as noted above.

The substrate 12 receives and mounts an indicia-bearing information label 30 thereonto. The information label 30 may be provided with an almost endless variety of information which the user may use to convey about the outside device to which the information label system 10 is being attached. By way of different examples, FIG. 3 shows two different information labels 30*a* and 30*b*. As illustrated, for example, the information label 30*a* bears a variety of sub-categories of information, including a month field displaying an array of first initials of all of the months of the year, and a date field, displaying an array of all of the dates possible within a month. Additional information fields such as the number of quarts of a fluid, such as oil, put into the outside device, which may be, for example, a lawn mower, as well as the number of ounces of fluid that were presumably added at the time that the label was used. Thus, the user of the information system 10, who may, for example, be someone changing the oil in a device such as a lawn mower, selects an appropriate label 30*a* and affixes it onto the substrate 12. And, as shown, alternatively, the label 30*a* may contain information such as ratios of one fluid to another. This is particularly useful in conjunction with the metering device of U.S. patent application Ser. No. 09/095,491.

The information label 30 may be provided with a means for securely mounting itself onto the substrate 12 and may preferably be a self-adhesive label. In the operation of mounting the label 30 onto the substrate 12, the user may be aided by the guide member 15. In a preferred embodiment, the guide member 15 may take the form of a raised rim around the outer periphery of the front or top face 12*a* of the substrate 12.

The information label 30 is then to be pre-formed of an appropriate size so that it fits in a single place within the rim guide member 15 extending from the substrate 12. The pre-formed information labels 30 are, of course, printed such that when mounted in their unique place upon the substrate 12, the various datum points, which have been previously located on the label, are aligned in registry above the array of the plurality of holes 14 within the substrate 12, which holes are also arranged in a precise and predetermined position.

Once the information label 30 has been attached to its unique position on the substrate 12, which may have been secured to an appropriate place on the lawn mower handle using the securement means 16, the operator can then complete the operation of changing the oil and then may punch the appropriate datum points indicating that, for example, on June 1, the oil was changed and that three quarts and five ounces of oil was used. Thus, through the use of this information label system, the device, in this example of a lawn mower, itself contains a system by which a subsequent user may know when the oil was last changed. When the next cycle of oil change is to be completed on this particular lawn mower, the next operator need merely to place a new self-adhesive label upon the old one in appropriate position on the substrate and repeating the cycle of perforating the appropriate datum points. The label is preferably made of a material which is easily, but not too easily perforated. Perforation may be accomplished using any simple device such as using the end of a pen or pencil. Thus the material of which the label is made should have appropriate resistance such that it can be easily perforated by the end of a pencil, but is otherwise resistant to inadvertent perforation by a fingernail or other inadvertent force applied to the device. Suitable materials include a heavy gauge paper, a foil or the like with an adhesive backing.

While it can be seen that the above-described information label system 10 provides an economical and convenient system by which a multiple number of changing employees may be informed about the specific condition of a particular device, such as a lawn mower, where the entity is a large commercial entity employing many employees and devices, the information label system may also be advantageously used by an individual device owner, such as a homeowner, who is simply not able to recall such a mundane event as changing oil.

Of course, the information label 30 may bear any type of information which the user deems appropriate for this specific device. Thus, and as noted below, for example, the information label 30*b* contains information about the equipment fuel and may have a sub-category of information indicating whether the fuel is regular gas or a two-cycle mix. A different sub-category of information may indicate how many ounces of fuel were added to the fuel tank, and yet a third sub-category of information may indicate ratios of one fuel to another, if in fact the fuel were a two-fuel mixture. A final sub-category of information may indicate the type of two-cycle oil used.

The information label system 10 of the present invention may be used for an endless variety of outside devices or products. For example, the information system can be used to convey the particulars of the outside device being shipped. A piece of furniture can convey an array of information about a specific model of a chair, such as whether its was formed of wood, plastic, metal or a particular combination of materials, its color and/or the color of any fabric, and the composition of the fabric, if any.

Where the information label system 10 is applied to an appropriate position on a transportation pallet or any other transportation device used to safeguard its contents, the information label system can be used any subsequent number of times to transport different items, such as the chair exemplified above, with the user simply applying a new label 30 and perforating the appropriate datum points to indicate the particulars about each subsequent chair used within that storage container.

While it will be appreciated by one of ordinary skill that the particular dimensions and composition of the elements within the information label system 10 of the present invention may be other than disclosed herein, details of a preferred embodiment of the present invention will now be provided. The substrate 12 may be formed unitarily along with the securement means 16, which can merely be a stem, of appropriate plastic, for example HDPE. The overall length of the substrate 12 and (stem) elongated member 18 may be about 9 inches long by 1¼ inches wide, The stem or securement means 16 may be 6 inches long to allow its wrapping securement around a suitable portion of the machinery about which information is to be conveyed. Obviously, these lengths are easily variable where needed to accommodate different sized machinery. The substrate 12 may be approximately 1¼ inches wide and 3 inches long and about ½ inch thick. The paddle portion of the substrate 12 may have an array of about 66 holes 14 each with a diameter of about 1/16 inch (0.0625 inch). The holes 14 may extend either entirely through, or partially through the thickness of the paddle 12. The guide member 15 may take the form of a raised rim rising about 1/64 inch (0.0156 inches) above the top surface 12*a* of the paddle portion, the rim preferably extending around the entire periphery to ensure that the unique and correct placement of an information label 30 on the substrate 12. If desired, the guide member 15 can further comprise additional elements, such as a pair of raised posts 32 located at the top portion of the substrate, each post rising upwardly from the top surface 12*a* to engage appropriately positioned holes in the information label 30 to further ensure its unique and correct positioning on the substrate 12. The posts 32 may rise approximately 1/16 inch (0.0625 inch) above the top surface 12*a* of the substrate 12.

The information label 30, which is appropriately sized as described above to fit in a unique and correct position upon the substrate 12, such that the datum points are aligned in registry above the array of holes 14 in the substrate 12. The information labels 30 may be color coded to further facilitate the selection of the appropriate label by the user. When the condition of the device changes, a new label may be attached directly above the old label already on the substrate 12, further facilitating the use of this system. Alternatively, when a number of labels have been so affixed to the substrate, such that they rise above the upward extension of the guide member 15, these labels can be removed by prying off the bottom label with any simple device, such as by the point of a pencil.

As the preferred embodiment of the information label system is formed of a plastic of appropriate strength for its particular application, where necessary, the information label system 10 can be removed by simply cutting the securement means 16 from the outside device to which it has been previously affixed. This may be desirable, for example, where the label system is used upon an article such as a chair or a piece of clothing where the information label system may be useful to the seller, but is not useful to the end user.

Figure 4:
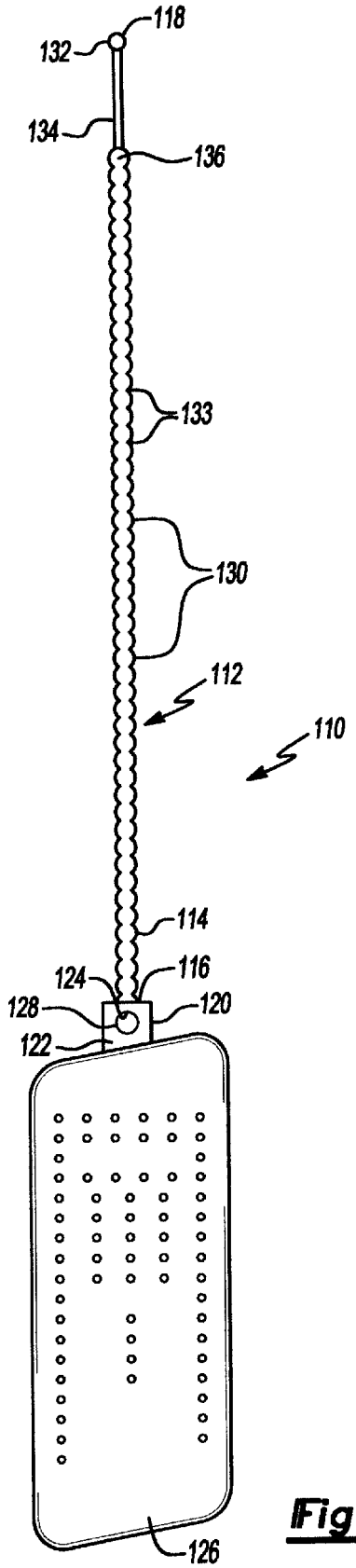
FIG. 4 is a top plan view of an alternate embodiment hereof.

Referring now to FIG. 4, there is disclosed an alternate embodiment of an information label system of the present invention and, generally, denoted at 110. According to this embodiment, the means for securement, shown at 112, comprises an elongate member 114 having a proximal end 116 and a distal end 118, and a locking element 120.

The locking element 120 is defined by a locking head or block 122 having a center aperture 124 formed therethrough. The locking head 122 is affixed to a substrate 126 by any suitable means, such as being integrally formed therewith, sonic welding, fusion or the like. The central aperture 124has a flexible ring 128 circumferentially disposed therewithin and is integrally formed therewith. By forming the ring 128 as a thin-walled member, such as by molding from a suitable plastic, the desired flexibility is imparted thereto.

As shown, the elongate member 114, which is, also, flexible, extends from the block 122 and is integral therewith. The elongate member 114 comprises a plurality of integrally formed orbs or spherical beads 130 provided substantially along the extent thereof with a reduced diameter portion 133 between adjacent orbs. The elongate member terminates at a knob 132 with a cylindrical portion 134 interposed between the knob 132 and the terminal orb 136.

In use, the knob 132 is inserted into the aperture 124 and is threaded therethrough past the ring 128. The ring releasably holds the elongate member 114 in position by engaging any desired reduced diameter portion 133. According to this embodiment, the elongate member 114 is flexible and can be threaded through either side of the block 122 and can be easily removed therefrom due to the flexibility and ease of getting past the ring 128.

Preferably, the entire device is fabricated as a unitary member by molding or the like from any suitable plastic, such as HDPE, or other material. This embodiment is used and deployed in the same manner as the first embodiment.

Although various embodiments of the invention have been disclosed for illustrative purposes, it is understood that variations and modifications can be made by one skilled in the art without departing from the spirit of the invention.

Having thus described the invention, what is claimed is:

1. An information labeling system, said system comprising:

a substrate having a plurality of holes arranged in an array of predetermined positions, a perforatable information label having datum points in an array of known positions adapted to be aligned in registry with said arrayed plurality of holes on said substrate, said substrate includes alignment means for aligning the label on the substrate to ensure that the datum points are in registry with the arrayed plurality of holes, said alignment means further comprising a pair of guide posts for positioning the label relative to the holes, the guide posts projecting upwardly from the substrate; and securing means for securing the substrate to a device about which information is to be conveyed.

2. The information labeling system as claimed in claim 1, wherein said alignment means comprises a rim extending upwardly from and at least in part about the substrate periphery.

3. The information labeling system as claimed in claim 1, wherein said alignment means comprises a rim extending upwardly, at least in part, from the outer periphery of said substrate, and a pair of guide posts extending upwardly from said substrate, said rim and guide posts positioning the label relative to the holes.

4. The information labeling system as claimed in claim 3, wherein said rim and said guide posts are dimensioned to extend from said substrate by an amount sufficient to enable multiple labels to be successively positioned on the substrate and be perforated at selected datum points.

5. The information labeling system as claimed in claim 1, wherein said securing means comprises a locking head provided with a passageway therethrough, an elongated locking strap adapted to be received in said passageway, said locking strap having a proximal end connected to said locking head and a distal end to draw the locking strap into said passageway, and means for locking the locking strap in said passageway.

6. The information labeling system as claimed in claim 5, wherein said locking strap includes a succession of openings between its opposite ends, and said locking head includes a locking element, said locking element extending at an acute angle for engagement with an opening.

7. The information labeling system as claimed in claim 6, wherein said locking element is disposed in said passageway.

8. The information labeling system as claimed in claim 5, wherein said locking strap and said locking head are integrally formed.

9. The information labeling system as claimed in claim 5, wherein said locking strap comprises a succession of generally spherical beads, adjacent pairs of beads defining a reduced diameter portion, and said passageway includes a resilient locking element, said locking element being adapted to seat within a reduced diameter portion to inhibit unwanted movement of the locking strap relative to the locking head but yield upon application of sufficient force to allow the locking strap to move relative to the locking head.

10. The information labeling system as claimed in claim 9, wherein said locking element comprises a circular ring, the diameter of said ring being slightly less that the maximum diameter of said spherical beads.

11. The information labeling system as claimed in claim 9, wherein said locking strap and said locking head are integrally formed.

12. The information labeling system as claimed in claim 1, further comprising means for detachably securing said label to said substrate.

13. The information labeling system as claimed in claim 12, wherein said means for detachably securing comprises an adhesive for adhering to the label to the substrate.

14. The information labeling system as claimed in claim 13, wherein said label is selected from the group of materials consisting of a heavy gauge paper or a foil with an adhesive backing.

15. A labeling system for use in providing information and particulars about a device such as for shipping and maintenance details, said labeling system comprising:

a paddle of predetermined thickness, said paddle having a top surface and a plurality of openings extending at least in part into said top surface, said openings being positioned in predetermined locations, an elongated stem, said stem having a proximal end and a distal end and adapted to be secured to the device, means for connecting the elongated stem to the paddle, and a perforatable information label having datum points disposed in preselected locations, the datum points at said preselected locations being adapted to be aligned in registry with an opening corresponding thereto in said paddle for perforation therein when the label is mounted on said top surface.

16. The labeling system as claimed in claim 15, further comprising a locking head, said head having a passageway therethrough and a locking member in said passageway, and further wherein said stem is generally planar and connected at its proximal end to said head, said stem being adapted to be threaded through the passageway and engaged by said locking member.

17. The labeling system as claimed in claim 16, wherein said paddle includes means for positioning the label relative to said openings, said means including a guide member projecting from the top surface and around the openings.

18. The labeling system as claimed in claim 17, further wherein the paddle is approximately 1¼ inch wide, 3 inches long, ½ inch thick and includes an array of about 66 openings, each opening having a diameter of about 1/16 inch, and said guide member projects approximately 1/64 inch from the top surface of the paddle.

19. The labeling system as claimed in claim 18, wherein said means for positioning includes a pair of posts extending from the top surface of said paddle and a pair of locating holes in said label, said guide posts being received in said locating holes whereby to position the datum holes with the openings in the paddle.

20. The labeling system as claimed in claim 19, further comprising a locking head, said head having a cylindrical passageway therethrough for receiving said stem, and a locking member in said passageway, and further wherein said stem comprises an elongate member having a succession of spherical heads disposed between its distal and proximal ends, the proximal end being integrally formed with said locking head and said spherical heads defining a series of reduced diameter portions which are engaged by said locking member.

21. An information labeling system, said system comprising:

a substrate having a plurality of holes arranged in an array of predetermined positions, a perforatable information label having datum points in an array of known positions adapted to be aligned in registry with said arrayed plurality of holes on said substrate, said substrate includes alignment means for aligning the label on the substrate to ensure that the datum points are in registry with the arrayed plurality of holes, said alignment means further comprising a rim extending upwardly, at least in part, from the outer periphery of said substrate, and a pair of guide posts extending upwardly from said substrate, said rim and guide posts positioning the label relative to the holes; and securing means for securing the substrate to a device about which information is to be conveyed.

22. An information labeling system, said system comprising:

a substrate having a plurality of holes arranged in an array of predetermined positions, a perforatable information label having datum points in an array of known positions adapted to be aligned in registry with said arrayed plurality of holes on said substrate; and securing means for securing the substrate to a device about which information is to be conveyed, said securing means further comprising a locking head provided with a passageway therethrough, an elongated locking strap adapted to be received in said passageway, said locking strap having a proximal end connected to said locking head and a distal end to draw the locking strap into said passageway, and means for locking the strap in said passageway.

* * * * *